United States Patent [19]

Snediker, Sr. et al.

[11] Patent Number: 4,948,012

[45] Date of Patent: Aug. 14, 1990

[54] DISPENSER FOR SOLID COMESTIBLES

[75] Inventors: Robert R. Snediker, Sr., Winnetka; Robert R. Snediker, Jr., Northfield, both of Ill.

[73] Assignee: Chicago Show Printing Company, Morton Grove, Ill.

[21] Appl. No.: 278,049

[22] Filed: Nov. 30, 1988

[51] Int. Cl.[5] ..... B65H 3/60

[52] U.S. Cl. ..... 221/195; 221/202; 221/254

[58] Field of Search ..... 221/200, 202, 254, 263, 221/268, 269, 191, 193, 194, 195; 222/216, 222, 228, 243, 247, 248, 344, 353, 361, 362, 457

[56] References Cited

U.S. PATENT DOCUMENTS 1,436,749 11/1922 Zeschmar ..... 221/263 X
1,861,834 6/1932 Binggeli ..... 221/195 X
2,962,190 11/1960 Horland ..... 221/263 X
3,757,994 9/1973 Skoetsch ..... 221/269 X

FOREIGN PATENT DOCUMENTS 449088 6/1948 Canada ..... 221/200

*Primary Examiner*—Kevin P. Shaver
*Assistant Examiner*—David H. Bollinger
*Attorney, Agent, or Firm*—Neuman, Williams, Anderson & Olson

[57] ABSTRACT

A dispenser for solid comestibles is disclosed which has a reservoir for containing the comestibles, a port for accessing the comestibles, a channel interposed between the port and the reservoir and a displacement mechanism which dispenses a consistent quantity of the comestibles without mutilating or guillotining the comestibles and which does not become clogged during operation.

10 Claims, 1 Drawing Sheet

DISPENSER FOR SOLID COMESTIBLES

BACKGROUND OF THE INVENTION

Hotels, restaurants, bars, clubs and other service establishments often freely dispense nuts, fruits, candies, mints and other hard candies to their guests or customers. Often these establishments place the comestibles in a bowl, dish or plate and offer them to the guests or customers. When the comestibles are offered in this manner, guests or customers must scoop up or grab the comestibles with their hands. Such scooping or grabbing presents several problems. First, the comestibles may be inadvertently spilled or scattered from the dish or bowl, thus causing waste and making an unsightly display. Second, for health and sanitary reasons, people may be unwilling to eat comestibles that have been offered in a dish or bowl because the comestibles may have been touched by other persons.

Various solid comestible dispensers were thus developed to allow hotels, restaurants, bars, clubs and other service establishments to place the comestibles in an enclosed reservoir with an attached dispensing mechanism. Such devices allowed the customer to turn a handle or push a lever to cause a predetermined amount of comestibles to drop down a shoot into the customers waiting hand. These dispensers avoided the problem of spilled comestibles and also prevented customers from touching the comestibles in the reservoir. Thus, these dispensers were both neat and sanitary.

However, due to certain design characteristics, these prior dispensers have been beset with one or more of the following shortcomings: (1) the prior dispensers failed to dispense a consistent quantity of comestibles; (2) the prior dispensers had a tendency to become jammed with the comestibles, thus preventing the flow of comestibles to the customer or guest; (3) the prior dispensers had a tendency to guillotine or mutilate the comestible thus dispensing particles and portions of the comestibles and causing waste.

SUMMARY OF THE INVENTION

Thus, it is an object of the invention to provide a solid comestible dispenser which avoids the aforementioned shortcomings.

It is a further object to provide a dispenser which dispenses a consistent quantity of comestibles.

It is a further object to provide a dispenser which does not become jammed with comestibles thus preventing dispencement.

It is a further object to provide a dispenser which does not guillotine or mutilate the comestibles.

In accordance with one embodiment of the invention, a dispenser of solid comestibles is provided for dispensing predetermined portions of solid comestibles without jamming or guillotining or mutilating the comestibles. The dispenser includes a reservoir for holding the solid comestibles and a port for accessing said comestibles. A channel is interposed between the port and the reservoir. A selectively operable displacement mechanism is also provided for displacing a predetermined portion of the solid comestibles from the reservoir into the channel for access at the port.

DESCRIPTION OF THE DRAWINGS

For a more complete understanding of the invention, reference should be made to the drawings wherein.

DETAILED DESCRIPTION OF THE INVENTION

Although the disclosure hereof is detailed and exact to enable those skilled in the art to practice the invention, the physical embodiment herein disclosed merely exemplifies the invention which may be embodied in other specific structures. The scope of the invention is defined in the claims appended hereto.

Figure 1:
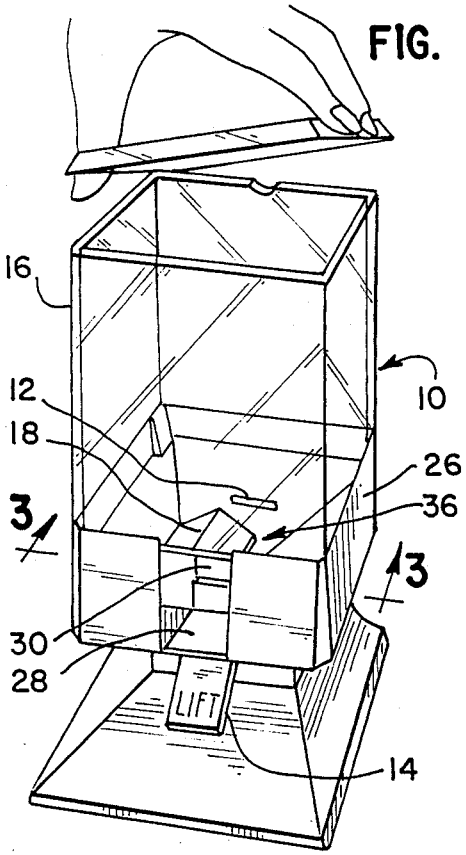
FIG. 1 is a perspective front and side view of one embodiment of the dispenser for solid comestibles.
Figure 4:
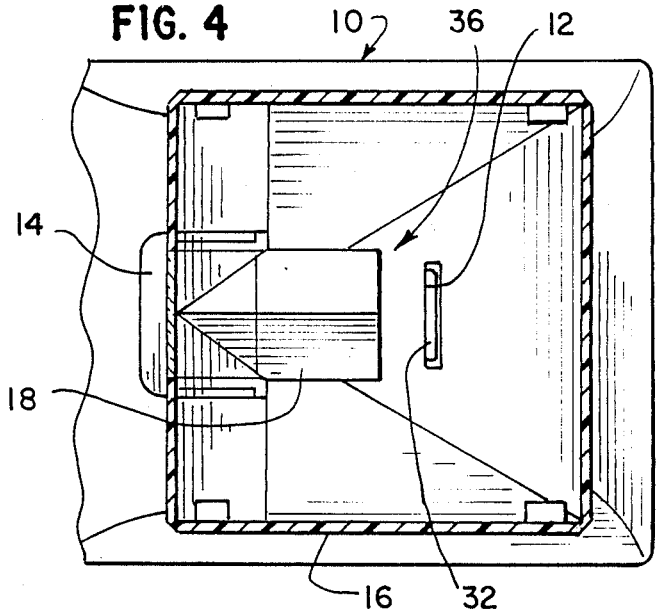
FIG. 4 is a top cutaway view along line 4—4 in FIG. 2 of the dispenser for solid comestibles.

Referring now to the drawings and more particularly to FIG. 1, a preferred embodiment of the dispenser for solid comestibles 10 is shown.

The preferred embodiment of the dispenser 10 shown in FIG. 1 includes a reservoir 16 mounted on a base 26 for containing the solid comestibles. During normal operation, the solid comestibles pass through an opening 36 from the reservoir 16 into a channel 30. The solid comestibles are transported from the channel 30 to a port 28 by means of a lever 14.

Figure 2:
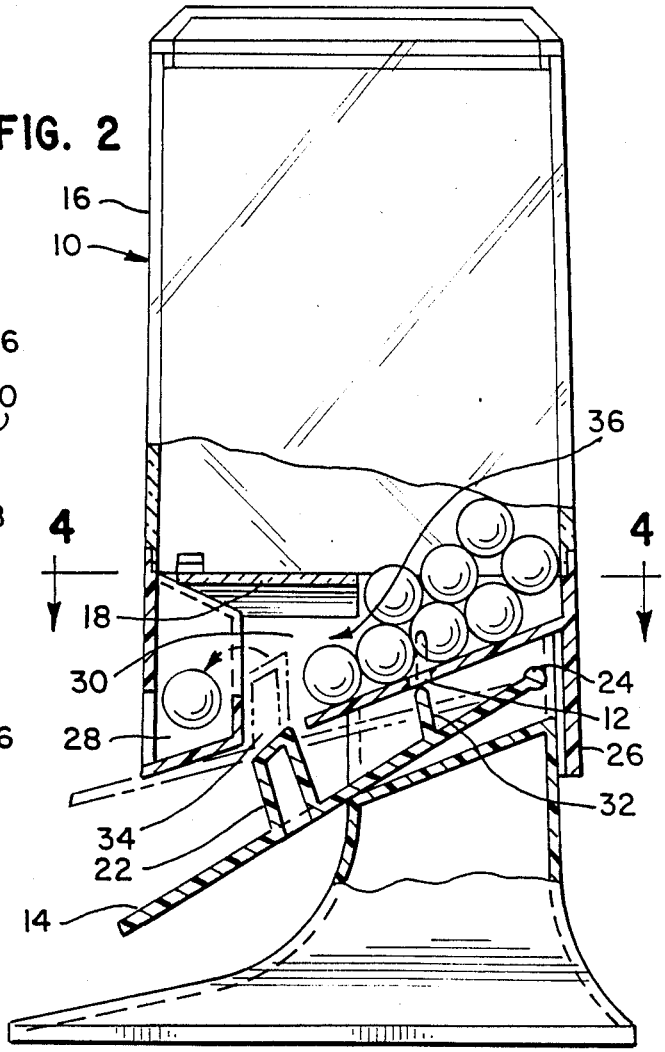
FIG. 2 is a side view of the dispenser for solid comestibles.

Turning now to FIG. 2, when the lever 14 is activated in a vertical, upward direction, a rectangular projection 22 is thrust through an opening 34 and displaces a predetermined number of solid comestibles from channel 30 into port 28 where the solid comestibles are accessible for removal from the dispenser. Simultaneously, with the displacement of the solid comestibles, a tab 32 attached perpendicularly on the lever 14 is thrust through a slot 12, the slot 12 being a predetermined distance from the channel 30. When the tab 32 is thrust through the slot 12, it acts as an agitator to disrupt settling that may have occurred in the product in the reservoir. Also, when the lever is raised to dispense some of the comestibles, the rectangular projection 22 impedes the flow of solid comestibles from the reservoir 16 to the channel 30 thus preventing the solid comestibles from clogging the channel 30. In this fashion, the invention has the advantage of an upward lever action which displaces a predetermined quantity of comestibles, thus preventing waste. Furthermore, the upward lever action prevents guillotining of the comestibles and also prevents clogging of the dispensing mechanism.

It should also be noted that when the lever 14 is in the released position, the top of the rectangular projection 22 forms the bottom of the reservoir 16 at the point of the slot 34 thus preventing comestibles from falling through the slot 34. The lever 14 is attached to the dispenser 10 by a hinge 24 at the rear of the base 26 of the dispenser.

Figure 3:
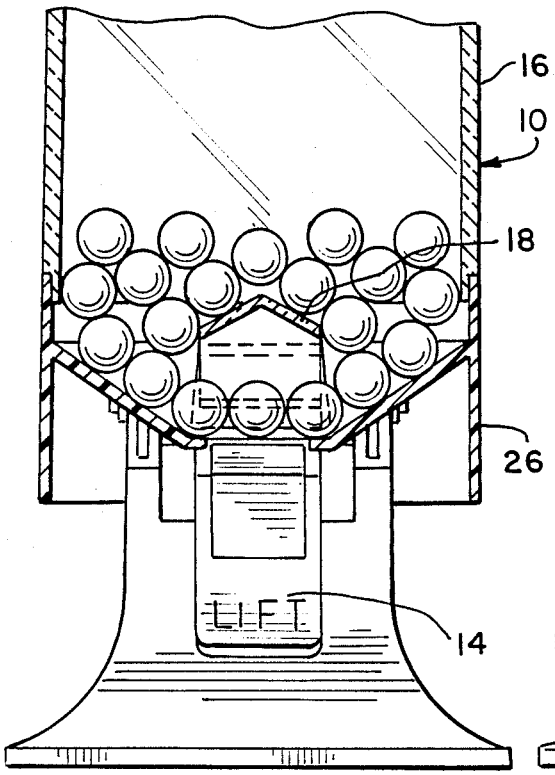
FIG. 3 is a front cutaway view along line 3—3 in FIG. 1 of the dispenser for solid comestibles.

To prevent the comestibles from clogging the channel 30, a partition 18 is positioned above the channel separating the reservoir 16 from the channel 30. As shown in FIG. 3, the partition 18 allows only a limited number of comestibles to enter the channel area for discharge into the port 28.

The dispenser will dispense a predetermined number of solid comestibles from the dispenser upon the upward movement of the lever 14. A predetermined number of comestibles are positioned directly above the tab 22. The upward movement causes the rectangular projection 22 to project through the slot 34 into the reservoir 16. The top surface of the rectangular projection 22 is slanted towards the channel 30. Thus, when the rectangular projection 22 rises, the comestibles displaced by rectangular projection 22 are thrust towards channel 30 by the slanted portion of rectangular projection 22. The comestibles thus travel through channel 30 and into port 28 where they are accessible to the consumer.

The configuration of the various components of the dispenser of solid comestibles may vary from that shown without departing from the scope of the claimed invention.

I claim:

1. A dispenser for solid comestibles comprising:

a reservoir mounted on a base for containing said solid comestibles;

a port for accessing said solid comestibles;

a channel formed in said base interposed between said port and said reservoir, said channel receiving and guiding said comestibles to a predetermined position within said channel from one or more directions;

a partition wall disposed above said channel for selectively directing said solid comestibles into said channel, said partition wall permitting the movement of said comestibles into said channel from one or more directions within said reservoir;

a lever for displacing said solid comestibles at said predetermined position in said channel in an upward direction from said channel into said port;

a tab on said lever for agitating said comestibles within said reservoir and inhibiting the movement of said comestibles within said channel when said lever is in an operable position;

a rectangular projection on said lever to displace said comestibles from said channel into said port when said lever is in said operable position, said rectangular projection having an angular surface for directing said comestibles into said port, and said rectangular projection forming a bottom portion of said channel when said lever is in an non-operable position.

2. The dispenser of claim 1 wherein said tab is disposed normal to said lever so that when said lever is moved to said operable position to displace said comestibles, said tab is thrust through a slot in said base into said reservoir.

3. The dispenser of claim 1 wherein said lever is provided with an end segment attached to fulcrum means and a distal end segment having an exposed lifting portion to move said lever to said operable position for displacing said comestibles in said upward direction from said channel.

4. The dispenser of claim 3 wherein said fulcrum means comprises hinge means attached to a rear portion of said base allowing said lever to rotate in a vertical fashion.

5. A dispenser for solid comestibles comprising:

reservoir means mounted on base means for containing said solid comestibles;

channel means formed in said base means for receiving and guiding said comestibles to a predetermined position within said channel means from one or more directions;

partition means operatively disposed above said channel means for selectively directing said comestibles into said channel means, said partition means permitting the movement of said comestibles within said reservoir means into said channel means from one or more directions;

selectively operable displacement means for upwardly displacing said comestibles from said predetermined position in said channel means;

said displacement means comprising lever means with an exposed end segment for lifting said lever means from a first position to a second raised position, said lever means having a top surface and a bottom surface, said top surface provided with upwardly extending projection means, said projection means engaging said comestibles at said predetermined position in said channel to lift and eject said comestibles from said channel means when said lever means is moved from said first position to said second raised position;

said lever means further provided with upwardly extending tab means in spaced relation to said projection means for agitating said comestibles within said reservoir and inhibiting the movement of said comestibles within said channel means when said lever means is in said second raised position; and port means for receiving said comestibles displaced from said predetermined position in said channel means.

6. The dispenser of claim 5 wherein said projection means prevents movement of said comestible to said predetermined position in said channel means when said lever means is in said second raised position.

7. The dispenser of claim 5, wherein said projection means are provided with a distal end portion to engage said solid comestibles having a top surface angularly disposed relative to said top surface of said lever means.

8. The dispenser of claim 5 wherein said partition means comprise a downwardly angled V-shaped wall segment in spaced relation above said channel means.

9. The dispenser of claim 8 wherein said projection means are disposed in spaced relation to said partition means to prevent the flow of said comestibles to said predetermined position when said lever means is in said second raised position.

10. The dispenser of claim 5 wherein said lever means are provided with an end segment attached to fulcrum means, said fulcrum means comprising hinge means fixed to a rear portion of said base means allowing said lever means to rotate in a vertical fashion.

* * * * *